United States Patent [19]

Stubbs

[11] Patent Number: 4,597,500

[45] Date of Patent: Jul. 1, 1986

[54] TAMPER-RESISTANT CLOSURES FOR CONTAINERS

[75] Inventor: Peter Stubbs, Dartford, United Kingdom

[73] Assignee: Johnsen & Jorgensen (Plastics) Ltd., London, England

[21] Appl. No.: 705,664

[22] Filed: Feb. 26, 1985

[30] Foreign Application Priority Data

Mar. 1, 1984 [GB] United Kingdom ..... 8405427

[51] Int. Cl.[4] ..... B65D 41/48

[52] U.S. Cl. ..... 215/256; 215/258

[58] Field of Search ..... 215/256, 258; 220/268, 220/269, 270

[56] References Cited

U.S. PATENT DOCUMENTS

| | | | |
|---|---|---|---|
| 4,076,140 | 2/1978 | Perne | 215/256 |
| 4,303,167 | 12/1981 | Martinez | 215/256 |
| 4,342,400 | 8/1982 | Llera | 215/256 |

*Primary Examiner*—Donald F. Norton

*Attorney, Agent, or Firm*—Wood, Dalton, Phillips, Mason & Rowe

[57] ABSTRACT

A container closure has a cap part which can be removed from and replaced upon an associated container as required and a tamper evident tear band which has to be removed from the closure before the cap part can be initially removed from the container. The tear band is connected to the skirt of the cap part by a number of spaced apart relatively strong frangible nibs, the spaces between the nibs being each filled by a relatively weak thin web of material.

4 Claims, 6 Drawing Figures

TAMPER-RESISTANT CLOSURES FOR CONTAINERS

BACKGROUND OF THE INVENTION

1. Field of the Invention

This invention relates to the provision of an improved tamper-resistant closure for a container and to an improved tamper-resistant container and closure assembly.

2. Background Art

Tamper-resistant closures have been known for some years for example closures known under our Registered Trade Mark JAYCAP are very popular. JAYCAP closures consist of a cap part, a tear band, an anchor band and a hinge connecting the cap part to the anchor band. Lines of weakness connect the cap part to the tear band and the tear band to the anchor band so that the tear band can be torn away easily. JAYCAP closures work extremely well when the closures are made from an easily tearable plastics material such as low density polyethylene but are not so effective when attempts are made to make JAYCAP closures from a stronger plastics material such as high density polyethylene or polypropylene that is not readily tearable.

To make tamper-resistant closures from the stronger materials has therefore involved special problems and a solution that has been successfully adopted is to connect the various parts of the closure together by spaced apart frangible nibs or tongues leaving spaces in between. We have adopted that technique in the manufacture of closures known under our Registered Trade Mark JAYPOUR. However, experience has shown that there are one or two drawbacks in the use of the spaced apart nibs. Firstly, the spaces in between the nibs tend to collect dust and, although the contents can be effectively sealed from the spaces, customers do not like to see dust collecting in that way because it looks so unhygenic. Secondly, there is a moulding problem due to the fact that hot moulding plastics material is introduced into the mould e.g. at the top dead centre and flows outwards and downwards around the core pin, cooling and solidifying all the time. As the material reaches the lower part of the closure the material meets an obstruction forming the spaces between the nibs, the only flow paths being provided by the nib channels, and this sometimes leads to the production of a faulty tear band through incompletely filling. Attempts to do away with the nibs and to provide wafer thin lines of weakness have failed because the lines of weakness had to be so thin to permit tearing that in many cases the membranes did not exist at all. In addition, parts of the component beyond the failed membrane are usually malformed.

SUMMARY OF THE INVENTION

It is the main object of this invention to overcome the above difficulties and to provide a tamper-resistant closure that can be made equally well from relatively soft material such as low density polyethylene or realtively hard material such as high density polyethylene or polypropylene.

According to the present invention there is provided a container closure comprising a cap part connected to a tear band by a frangible line of weakness characterised in that the line of weakness comprises spaced apart relatively strong nibs separated from one another by relatively weak sections each in the form of a fine web interconnecting adjacent nibs. We believe that this new arrangement represents a breakthrough in closure technique because in one step we have not only overcome the dust collection problem but we have provided a much increased and improved flow path for the moulding material.

In order that the invention may be clearly understood and readily carried into effect reference is now directed to the drawings given by way of example.

DETAILED DESCRIPTION OF THE DRAWINGS

Figure 1:
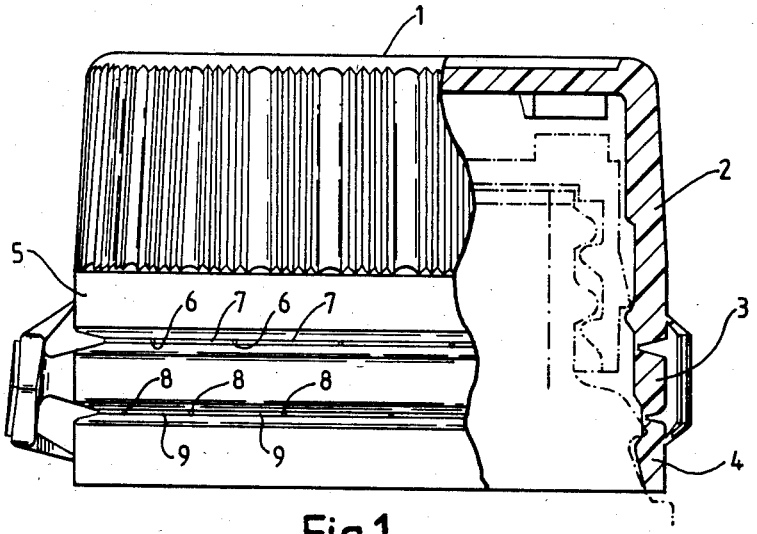
FIG. 1 is a sectional side-view of a closure according to the invention.
Figure 5:
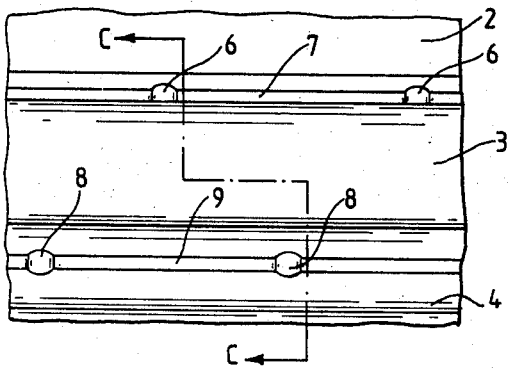
FIG. 5 is a detail view to a larger scale showing the tear band membranes and nibs.

In the drawings the cap shown as an example has a top 1, a skirt 2, a tear band 3 and an anchor band 4. The skirt 2 is fluted or serrated at the upper part of the side leaving a plain section 5 at the lower part. The bottom edge of the skirt 2 is connected to the upper edge of the tear band 3 by relatively strong spaced apart nibs 6 and the spaces between the nibs 6 are filled by relatively weak webs 7 which interconnect adjacent nibs 6. In the like manner the lower edge of the tear band 3 is connected to the upper edge of the anchor band 4 by relatively strong spaced apart nibs 8 and the spaces between the nibs 8 are filled by relatively weak webs 9 which interconnect adjacent nibs 8. Preferably and as shown in FIG. 1 the nibs 6, 8 and the webs 7, 9 are arranged in a staggered relationship in the sense that the nibs 8 are not directly below the nibs 6 but are each directly below the middle of a web 7.

This new arrangement aids moulding, enhances tearing and does not let dust collect in between the nibs. Essentially the nibs 6, 8 may be looked upon as holding the parts 2, 3, 4 together and the webs 7, 9 may be looked upon as filling the windows or spaces between the nibs. Using our new technique we have found that effective tamper-resistant closures can be made from both hard and soft plastics material including low and high density polyethylene, linear low density polyethylene, polypropylene, impact-modified polystyrene, copolymers of these materials and so on.

We have therefore provided a tamper evident container closure, which has a part that must be torn away before the closure can be removed from the container, along a tear line that consists of webs of relatively thin material and nibs of relatively thick material separated from one another by the webs. A suitably shaped tear tab with tell tale bridge members may be provided as indicated at the left of FIG. 1 together with additional bridge members spanning the tear band 3 as shown at the right of FIG. 1.

We are also using this invention in our new TRaCeR Safe closure illustrated in FIGS. 3 to 6.

Figure 6:
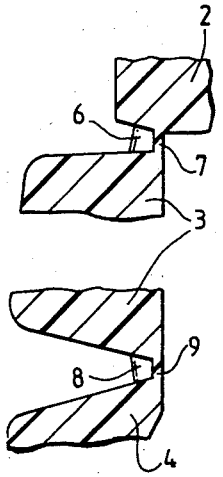
FIG. 6 is a detail view in section, showing the upper and lower webs and nibs, the section being taken on the line C—C of FIG. 5.
Figure 2:
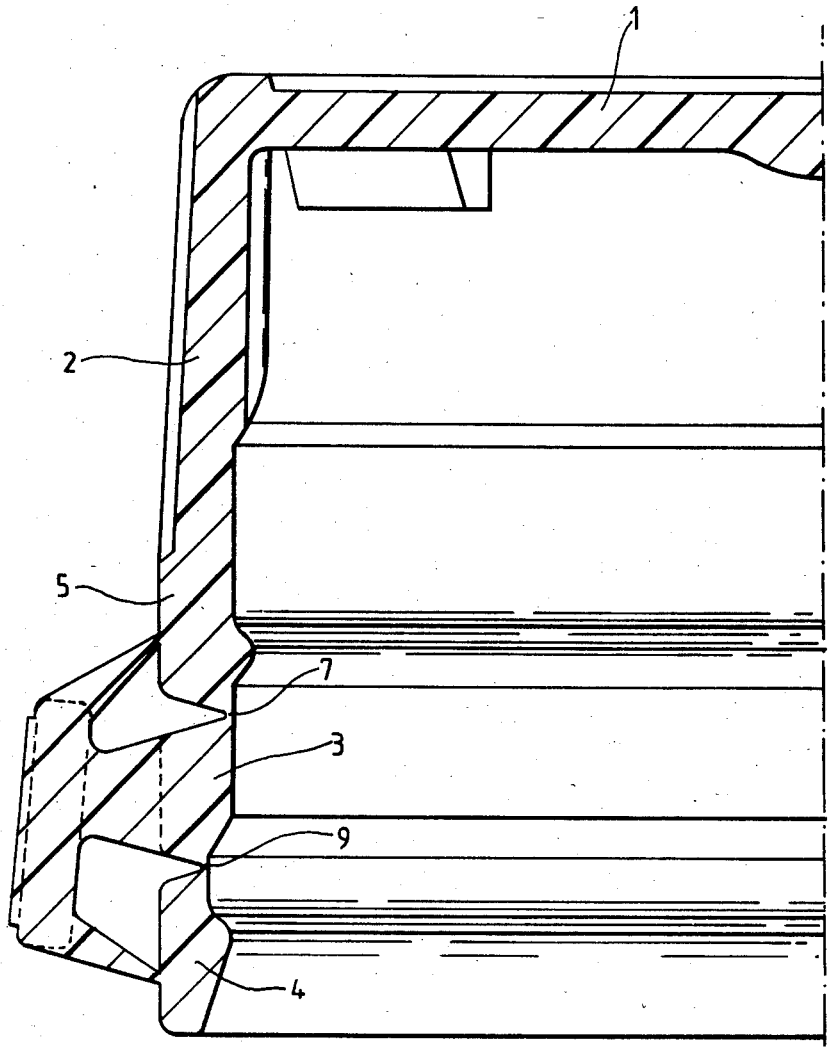
FIG. 2 is a detail view to a larger scale.
Figure 3:
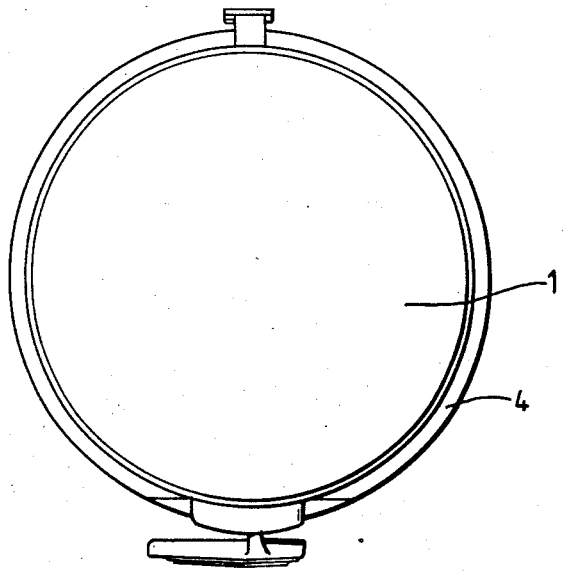
FIG. 3 is a plan of the closure.
Figure 4:
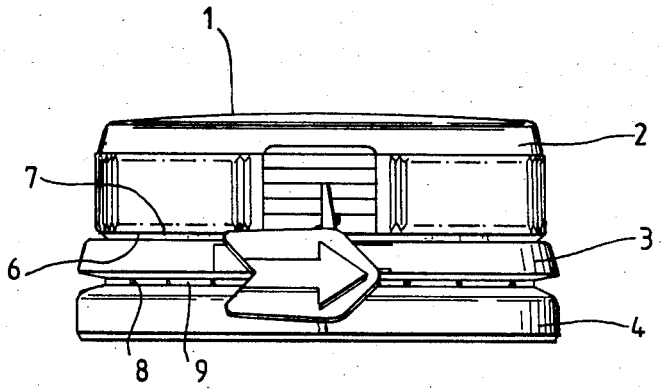
FIG. 4 is a side view of the closure.

In FIGS. 3 to 6 the same reference are used as in FIGS. 1 and 2. In our TReCeR safe closure there are twenty one nibs 6 and twenty two nibs 8. As shown in FIG. 6 the nibs 6 connecting the skirt 2 to the tear band 3 are inclined downwardly and outwardly while the nibs 8 connecting the tear band 3 to the anchor band 4 are inclined downwardly and inwardly. The nibs and webs 6,7 and 8,9 which form lines of weakness or membranes to permit the tear band 3 to be torn away when it is desired to remove the closure from an associated container, one recessed inwardly relatively to the skirt, tear band and anchor band 2,3,4 in order to protect the nibs and webs from damage during transport and storage.

I claim:

1. A tamper-resistant container closure comprising a cap, including a top and a depending annular skirt arranged so that the cap can be removed from its operative position on the container without mutilation or destruction of the cap in order to open the container and can then be replaced in its operative position to close the container again, and a tamper-resistant tear band having an edge connected to the lower edge of the skirt of the cap and so arranged that the tear band has to be removed from the closure before the cap can be initially removed from the container, characterized in that the tear band is firmly connected to the lower edge of the skirt of the cap by a number of spaced apart relatively strong frangible nibs which each firmly connect the edge of the skirt to the edge of the tear band, and that the spaces between the nibs are each filled by a relatively weak thin web of material, whereby the band must be pulled with a greater force to cause the connection of the tear band edge and the skirt edge established by the nibs to fail, than a force required to tear the thin web of material.

2. A container closure according to claim 1 characterized in that the closure has an anchor band, the annular skirt being connected to the tear band by a first tear line consisting of the webs and nibs and the tear band being connected to the anchor band by a second tear line consisting of the webs and nibs, the nibs in the second tear line being staggered relative to the nibs in the first tear line.

3. A container closure according to claim 1 wherein the nibs and web material extend entirely around the cap so that the tear band is completely separable from the cap.

4. A container closure according to claim 1 wherein the cap and the tear strip cooperatively define a V-shaped recess opening away from the container, and the nibs and thin web reside entirely within the V and adjacent the apex of the V so that the nibs and thin web are protected against inadvertent rupture as might occur during handling of the container.

* * * * *